United States Patent [19]

Nilssen

[11] Patent Number: 4,667,131

[45] Date of Patent: May 19, 1987

[54] PROTECTION CIRCUIT FOR FLUORESCENT LAMP BALLASTS

[76] Inventor: Ole K. Nilssen, Caesar Dr., Barrington Hills, Ill. 60010

[21] Appl. No.: 612,058

[22] Filed: May 18, 1984

[51] Int. Cl.[4] ..... H05B 41/16

[52] U.S. Cl. ..... 315/275; 315/225; 315/307

[58] Field of Search ..... 361/93, 94, 95, 100; 315/106, 107, 127, 128, 225, 238, 275, 209 R, 307; 363/55, 56, 98

[56] References Cited

U.S. PATENT DOCUMENTS

| | | | |
|---|---|---|---|
| 4,370,600 | 1/1983 | Zansky | 315/106 X |
| 4,382,212 | 5/1983 | Bay | 315/225 |
| 4,398,126 | 8/1983 | Zuchtriegel | 315/127 |

*Primary Examiner*—David K. Moore

[57] ABSTRACT

In a series-resonant-loaded inverter-type electronic ballast for two rapid-start fluorescent lamps, in order to meet requirements for safety from electric shock hazard, as well as to protect the inverter circuit from over-load, means are provided by which the proper connection to the ballast of the fluorescent lamps is sensed by way of detecting the proper flow of lamp cathode heating currents. Then, after the circuit is initially turned on and if one of the lamp cathodes were to draw substantially less current than normally called for, the inverter circuit is shut down immediately. On the other hand, if each lamp cathode draws the expected amount of cathode heating current, the inverter circuit is not shut down immediately, but is allowed to operate for a time at least long enough to permit proper starting of the rapid-start fluorescent lamps. However, if the lamps do not start within about one second, the inverter circuit is shut down so as to prevent circuit-damaging overload; which is apt to result when a series-resonant-loaded inverter-type ballast is inadequately loaded. As an overall result, the ballast provides for overload protection as well as for electric shock protection for a person working with inserting and/or removing rapid-start fluorescent lamps from a lighting fixture having such a ballast.

2 Claims, 1 Drawing Figure

PROTECTION CIRCUIT FOR FLUORESCENT LAMP BALLASTS

BACKGROUND OF THE INVENTION

1. Field of Invention

The present invention relates to improved inverter-type ballasts for fluorescent lamps.

2. Related Applications

The applicant has three related applications pending: Ser. No. 412,771 entitled Ballasts With Built-in Ground - Fault Protection; Ser. No. 481,714 entitled Inverter-Type Ballast With Ground-Fault Protection; and Ser. No. 500,841 entitled Series - Resonant Electronic Ballast Circuit.

3. Description of Prior Art

It is a basic safety requirement of fluorescent lighting fixtures that they be substantially free of serious electric shock hazard to persons involved with removing and/or replacing fluorescent lamps therein.

Electronic or inverter-type high - frequency ballast, especially as used with many of the recently developed high-efficacy fluorescent lamps, require particularly high voltages to achieve proper lamp starting and operation. As a result, the voltages provided at the lamp sockets are particularly high and therefore present special electric shock hazards.

To mitigate these special electric shock hazards, which is necessary to achieve listing by Underwriters Laboratories, manufactures of such inverter-type fluorescent lamp ballasts have resorted to the use of an isolation transformer at the ballast output, thereby to isolate the electrodes in the lamp sockets from ground; which, in turn, provides for the requisite mitigation of electric shock hazards.

Prior-art inverter-type ballasts wherein electric shock hazard mitigation is achieved by the use of an isolation transformer at the ballast output are described in U.S. Pat. No. 4,277,726 to Burke and U.S. Pat. No. 4,392,087 to Zansky.

Another approach at achieving acceptable mitigation of electric shock hazard is provided in U.S. Patent No. 4,370,600 to Zansky and involves an arrangement whereby the inverter automatically ceases to operate in case a lamp is disconnected from but one of its socket electrodes. However, Zansky's approach is problematic in that it does not permit the use of standard wiring connections to the fluorescent lamps in case of a mult-lamp ballast; which, in turn, makes it impossible to provide such a ballast as a direct retro-fit replacement for an ordinary multi-lamp ballast.

SUMMARY OF THE INVENTION

Objects of the Invention

A first object of the present invention is that of providing an improved protection circuit for inverter-type fluorescent lamp ballasts.

A second object is that of providing an inverter - type fluorescent lamp ballast with improved means for minimizing electric shock hazards for persons having to service a lighting fixture having such a ballast.

A third object is that of providing an electronic ballast that is particularly safe and convenient to use in ordinary lighting fixtures for fluorescent lamps.

These as well as other objects, features and advantages of the present invention will become apparent from the following decription and claims.

Brief Description

In its preferred embodiment, subject invention constitutes a power-line-operated inverter-type fluorescent lamp ballast that consists of the following prinicpal component parts:

(a) A rectifier means operable to provide a relatively constant-magnitude DC voltage;

(b) An inverter operable to convert this DC voltage into a 30 KHZ substantially squarewave voltage, which voltage is provided across the inverter's output;

(c) An L-C series-circuit connected across the inverter's output, this L-C series-circuit being substantially resonant at 30 KHZ;

(d) A pair of rapid-start fluorescent lamps series-connected in circuit across the capacitor of the L-C series-circuit;

(e) Three windings tightly coupled with the inductor of the L-C series-circuit, these windings being operative to provide for low-voltage cathode heating of the cathodes of the rapid-start fluorescent lamps;

(f) Means for automatically disabling the inverter within about 10 milli-seconds after it initially starts operating, except if a special "negate disabling" signal is provided;

(g) Means to sense the presence of cathode heating currents in each one of all the lamp cathodes, and—in case all cathode currents are indeed present—to provide said special "negate disabling" signals within the initial 10 milli-seconds; and (h) Means for disabling the inverter within a period of about one second in case at least one of the fluorescent lamps is removed or fails to operate.

Thus, when used in an ordinary lighting fixture, subject ballast effectively mitigates against electric shock hazard by way of nearly instantly removing the lamp socket voltages in case a lamp is not fully inserted in its sockets. In other words, when attempting to insert a fluorescent lamp into one of its sockets in a lighting fixture while holding onto the lamp at its other end and touching its electrodes there (which represents the principal electric shock hazard situation), a person can not get a serious electric shock from a fixture with subject ballast. The ballast output would simply not be present if one of the lamps were not properly inserted into both of its sockets.

DESCRIPTION OF THE PREFERRED EMOBIDMENT

Description of Circuit Arrangement

Figure 1:
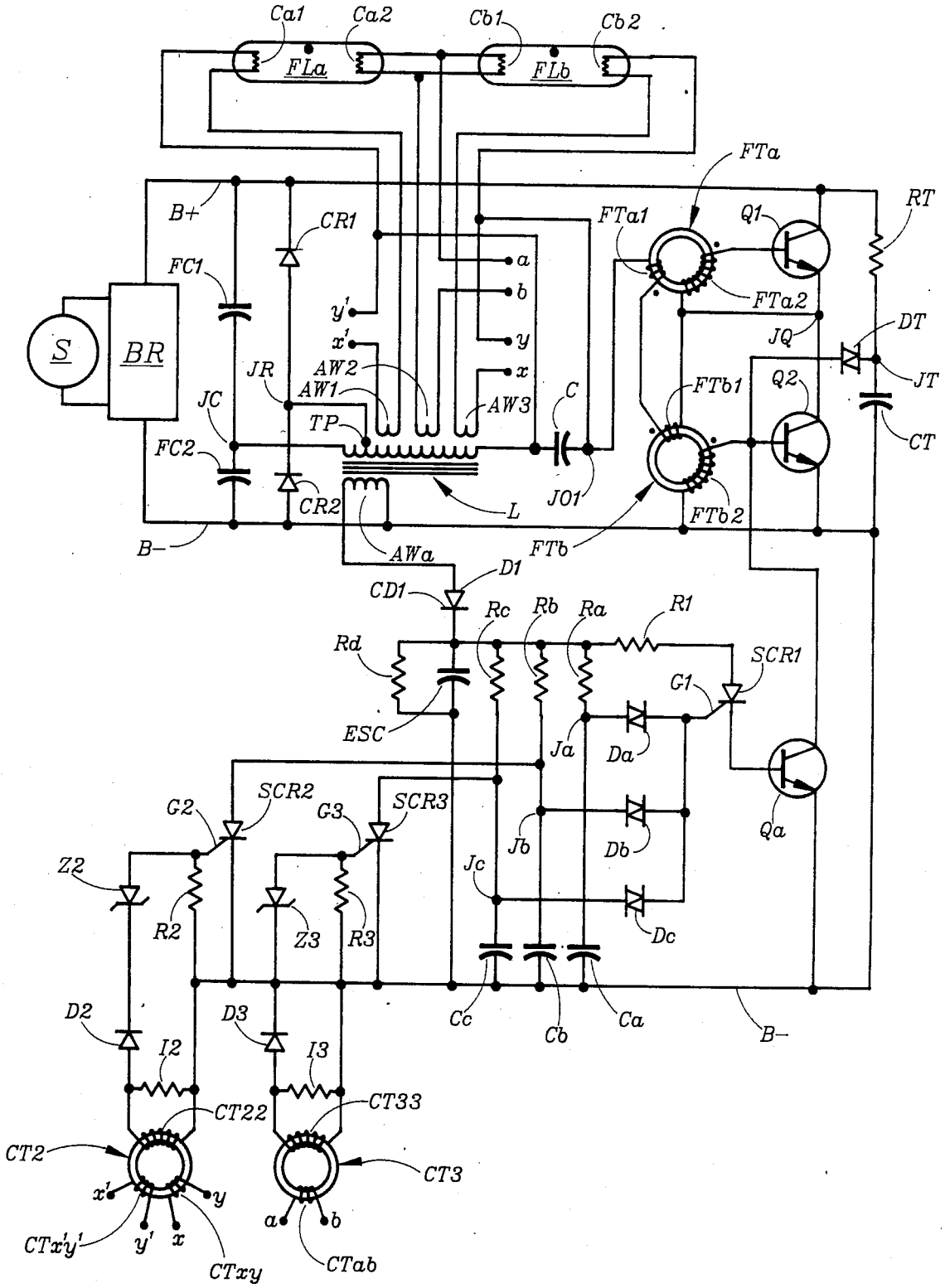
FIG. 1 schematically illustrates the preferred embodiment of the invention and shows an inverter-type series-resonant-loaded ballast for two rapid-start fluorescent lamps.

In FIG. 1, a voltage source S provides 120 Volt/60 Hz voltage to bridge rectifier BR, the output voltage of which is provided between two terminals marked B+ and B−, with the positive output voltage being applied to the B+ terminal. Two series-connected filter capacitors FC1 and FC2 are connected between the B+ and the B− terminal; which two capacitors are connected together at junction JC, thereby forming a power supply center-tap.

Two switching transistors Q1 and Q2 are connected in series between the B+ and the B− terminals: the collector of Q1 being connected with the B+ terminal, the emitter of Q1 being connected with the collector of Q2 at a junction JQ, and the emitter of Q2 being connected with the B− terminal.

A resistor RT is connected between B+ and junction JT; a capacitor CT is connected between JT and the B− terminal; and a Diac DT is connected between JT and the base of Q2.

The secondary winding FTa2 of feedback transformer FTa is connected between the base and emitter of transistor Q1. The secondary winding FTb2 of feedback transformer FTb is connected between the base and emitter of transistor Q2. The primary winding FTb1 of feedback transformer FTb and the primary winding FTa1 of feedback transformer FTa are connected in series between junction JQ and a junction JO1.

A capacitor C and an inductor L are connected in series between junctions JO1 and JC, and are connected together at junction JO2.

Inductor L has a tap-point TP connected to junction JR between clamping rectifiers CR1 and CR2. The cathode of CR1 is connected with the B+ terminal; its anode is connected with junction JR. The anode of CR2 is connected with the B− terminal; its cathode is connected with junction JR.

Tightly coupled with inductor L are three auxiliary windings AW1, AW2, and AW3. The output from winding AW1 is connected with cathode Cal of fluorescent lamp FLa by way of winding CTx'y' of cathode current sesnsing transformer CT2; the output from winding AW3 is connected with cathode Cb2 of fluorescent lamp FLb by way of winding CTxy of CT2; and the output from winding AW2 is connected with the parallel-combination of cathode CA2 of FLa and cathode Cbl of FLb by way of winding CTab of cathode current sensing transformer CT3.

Also tightly coupled with inductor L is an additional auxiliary winding AWa, the output of which is connected between the B− terminal and the anode of a diode D1. An energy storage capacitor ESC is connected between the B− terminal and the cathode CD1 of diode D1.

A resistor R1 is connected between CD1 and the anode of a silicon-controlled rectifier SRC1. The cathode of SCR1 is connected to the base of an auxiliary transistor Qa.

The collector of Qa is connected to the base of transistor Q2, and the emitter of Qa is connected to the B− terminal.

A resistor Ra is connected between CD1 and a junction Ja, and a capacitor Ca is connected between Ja and B−.

A resistor Rb is connected between CD1 and a junction Jb, and a capacitor Cb is connected between Jb and B−.

A resistor Rc is connected between CD1 and a junction Jc, and a capacitor Cc is connected between Jc and B−.

A Diac Da is connected between Ja and the gate G1 of SRC1; a Diac Db is connected between Jb and G1; and a Diac Dc is connected between Jc and G1.

The anode of a silicon-controlled-rectifier SCR2 is connected with Jb. The cathode of SCR2 is connected to B−.

The anode of a silicon-controlled-rectifier SCR3 is connected with Jc. The cathode of SCR3 is connected to B−.

A resistor R2 is connected between the gate G2 of SCR2 and B−; and a resistor R3 is connected between the gate G3 of SCR3 and B−.

The anode of a Zener diode Z2 is connected to G2; the anode of a Zener diode Z3 is connected to G3.

The cathode of Z2 is connected to the cathode of diode D2; the cathode of Z3 is connected to the cathode of diode D3.

Current transformer CT2 has a secondary winding CT22; current transformer CT3 has a secondary winding CT33.

Terminals x' and y' of winding CTx'y' are connected in series with one of the output leads of winding AW1; terminals x and y of winding CTxy are connected in series with one of the output leads of winding AW2; and terminals a and b of winding CTab are connected in series with one of the output leads of winding AW3.

Terminal y is connected with junction JO1; terminal y' is connected with junction JO2.

Output winding CT22 of transformer CT2 is connected between the anode of diode D2 and the B− terminal; output winding CT33 of transformer CT3 is connected between the anode of diode D3 and the B− terminal.

An impedance means I2 is connected across winding CT22; and an impedance means I3 is connected across winding CT33.

A loading resistor Rd is connected across capacitor ESC.

Description of Operation

The operation and use of subject inverter-type fluorescent lamp ballast arrangement may be explained as follows. In FIG. 1, ordinary electric utility power line voltage is rectified, filtered and provided across the two power supply terminals B+ and B− in the form of a DC supply voltage of substantially constant magnitude. By way of the junction between the two filter capacitors FC1 and FC2, this DC supply voltage is provided with a center-tap JC.

A self-oscillating inverter consisting of two switching transistors Q1 and Q2 in half-bridge configuration provides for a substantially squarewave voltage output between the DC voltage supply center tap JC and the junction JQ between the transistors. The inverter is made self-oscillating by way of the saturable current feedback transformers FTa and FTb.

The inverter is triggered into oscillation by way of the trigger arrangement consisting of resistor RT, capacitor CT and Diac DT.

The magnitude of the voltage drop across the two series-connected primary windings of current transformers FTa and FTb is substantially negligible; which implies that the voltage provided between junctions JO1 and JC is substantially the same as that provided between junctions JQ and JC.

The operation of the half-bridge inverter is described in further detail in U.S. Pat. No. 4,184,128 to Nilssen.

The squarewave output voltage from the inverter is provided between junctions JO1 and JC, across which junctions is connected a substantially resonant L-C series-circuit consisting of inductor L and capacitor C.

The half-bridge inverter with the series-resonant L-C circuit across its output constitutes the basic ballast circuit, with the principal ballast output being provided across capacitor C, between junctions JO1 and JO2.

Operation of the protection circuit may be described in detail as follows.

(a) The inverter can be triggered into and out of oscillation in the following manner.

(i) A brief voltage pulse applied to the base of transistors Q2, as is provided once every eight-to-ten seconds by the trigger circuit consisting of RT, CT and DT, serves to trigger the inverter into oscillation.

(ii) A complete, or nearly complete, short circuit briefly applied between base and emitter of transistor Q2, which may be provided by way of transistor Qa, serves to trigger the inverter out of oscillation.

(b) More specifically, the inverter may be triggered out of oscillation as follows.

(i) When the inverter is oscillating, capacitor ESC gets charged by way of winding AWa and diode D1. With the help of loading resistor Rd, the magnitude of the DC voltage across ESC is at all times approximately equal to the peak magnitude of the voltage provided at the output of winding AW1. Thus, before the lamps ignite, the DC voltage across ESC is relatively large; while after the lamps have ignited, the DC voltage across ESC is relatively low. The time-constant of ESC as loaded with Rd is on the order of 0.1 second.

(ii) Before the lamps ignite, the magnitude of the DC voltage across ESC is higher than the magnitude of the voltage required to cause breakdown of Diacs Da, Db and Dc; while after the lamps have ignited, the magnitude of the DC voltage across ESC is lower than the magnitude of the voltage required to cause breakdown of Diacs Da, Db and Dc.

(iii) Thus, before the lamps ignite, the magnitude of the DC voltage present across ESC is large enough to permit capacitors Ca,Cb and/or Cc to charge up to a voltage high enough to cause Diacs Da, Db and/or Dc to break down, thereby to provide a trigger pulse to the gate of SRC1.

(iv) After the lamps have ignited, however, the magnitude of the DC voltage across ESC is too low to permit capacitors Ca, Cb and/or Cc to charge up to a voltage high enough to cause Diacs Da, Db and/or Dc to break down.

(v) Before the lamps have ignited, capacitor Ca gets charged up by way of resistors Ra; and, within about one second (if the lamps have not ignited in the meantime ), the DC voltage across Ca reaches a magnitude sufficiently large to cause Diac Da to break down, thereby to cause capacitor Ca to discharge itself into the gate of SCR1 and to turn SCR1 into a conductive state.

(vi) With SCR1 conducting, ESC discharges itself into the base of transistor Qa, thereby causing this transistor to provide a near short circuit between the base and emitter of transistor Q2; and thereby, in turn, triggering the inverter out of oscillation. (The discharge time of ESC is governed by current-limiting resistor R1, and is chosen to have a time-constant of about two millisecond.)

(vii) However, if the lamps ignite before the voltage across Ca has reached a magnitude large enough to cause breakdown of Da, breakdown of Da will be prevented due to the very loading caused by the lamps: the charging of Ca will cease substantially from the moment of lamp ignition.

(viii) Also, before the lamps have ignited, capacitor Cb gets charged by way of resistor Rb; and, within about ten millisecond (except if prevented from occuring by the triggering of SCR2 into a conductive state), the DC voltage across Cb reaches a magnitude sufficiently large to cause Diac Db to break down, thereby to cause capacitor Cb to discharge itself into the gate of SCR1 and to turn SCR1 into a conductive state, thereby triggering the inverter out of oscillation.

(ix) Similarly, before the lamps have ignited, capacitor Cc gets charged by way of resistors Rc; and, within about ten millisecond (except if prevented from occuring by the triggering of SCR3 into a conductive state), the DC voltage across Cc reaches a magnitude sufficiently large to cause Diac Dc to break down, thereby to cause capacitor Cc to discharge itself into the gate of SCR1 and to turn SCR1 into a conductive state, thereby triggering the inverter out of oscillation.

(c) In other words, as described hereinabove, the inverter will automatically be triggered out of oscillation except if certain conditions materialize. More particularly, the inverter can be prevented from being triggered out of oscillation as follows.

(i) If an adequate combined magnitude of cathode current flows from windings AW1 and AW3 to cathodes Ca1 and Cb2, the voltage generated across impedance means I2 is of such magnitude as to give rise to a current through Z2 and into the gate of SCR2, thereby triggering SCr2 into a conductive state. In turn, with SCR2 conducting, the voltage on capacitor Cb is prevented from growing to the magnitude necessary for triggering the voltage of Z2 it is possible to make SCR2 trigger when both cathode currents are present; but not to trigger when only one of the cathode currents is present.

Thus, after the inverter is triggered into oscillation, if cathodes Ca1 and Cb2 are not both connected and drawing an adequate combined amount of current, the inverter will automatically be triggered out of oscillation within about 10 millisecond.

(ii) Similarly, if an adequate combined magnitude of cathode current flows from winding AW2 to cathodes Ca2 and Cb1, the voltage generated across impedance means I3 is of such magnitude as to give rise to a current through Z3 and into the gate of SCR3, thereby triggering SCR3 into a conductive state. In turn, with SCR3 conducting, the voltage on capacitor Cc is prevented from growing to the magnitude necessary for triggering the inverter out of oscillation. By proper selection of the Zener voltage of Z3 it is possible to make SCR3 trigger when both cathode currents are present; but not to trigger when only one of the cathode currents is present.

Thus, after the inverter is triggered into oscillation, if cathodes Ca2 and Cb1 are not connected and drawing an adequate combined amount of current, the inverter will automatically be triggered out of oscillation within about 10 millisecond.

(iii) If the inverter is not triggered out of oscillation within about 10 millisecond due to inadequate flow of cathode currents, as indicated above, it will continue to oscillate for at least one second or so. However, if the lamps have not ignited wihtin this one-second period, the inverter will be triggered out of oscillation because the voltage on capacitor Ca gets to grow to a magnitude large enough to cause breakdown of Diac Da; which, in turn, then gives rise to the triggering of SCR1 and the turning-on of Qa.

(iii) However, if all cathode currents are of normal magnitude and if the lamps ignite within a one-second period, then the inverter will not be triggered out of oscillation, but will continue to oscillate until turned off.

(iv) On the other hand, if the inverter does get triggered out of oscillation, it will remain out of oscillation until the trigger circuit consisting of RT, CT and DT provides the next trigger pulse, which is apt to be a few seconds later.

With the ballast circuit functioning as described above, the following significant effects result.

(a) If even one cathode of one lamp is disconnected from the circuit, the inverter will in effect be prevented from operating: it will be disabled within about 10 millisecond each time after it has been triggered into oscillation.

Thus, in a situation of having this type of ballast circuit operating the lamps in a lighting fixture, and nearly regardless of the magnitude of the voltages required for starting and operating the lamps, it would not be possible for a person to get a serious electric shock by way of holding onto the electrodes at the one end of a fluorescent lamp while inserting the electrodes on the other end of the lamp into their socket.

(b) Because of the extremely short period required for sensing the non-connection of a cathode and for correspondingly triggering the inverter out of oscillation, there will be no significant visible effect of having the circuit repeatedly try to re-start. That is, there will be no annoying blinking every few seconds as the inverter is retriggered.

Also due to the extremely short reaction period, there will be no significant wear on a lamp that might be connected while the circuit continously and repeatedly retriggers itself—a condititon that conceivably could go on for extended periods of time.

Moreover, in case of a burned-out or non-connected cathode, the amount of power drawn from the power line will be exceptionally low due to the extremely low duty cycle involved.

(c) If the lamps fail to ignite even if all the cathodes are properly connected and draw the proper amount of current —as could, for instance, happen under conditions of exceptionally low ambient temperatures—the ballast circuit will also shut itself off automatically, but in this case after about one second or so. Thus, because of the still relatively low on-versus-off duty cycle, and in contrast with what otherwise would have been the case, the net amount of power being drawn by the ballast from the power line is very modest.

Also due to the low on-versus -off duty cycle, the amount of power that has to be handled by the inverter's components has been reduced, thereby permitting the use of components with lower ratings than otherwise would have been the case.

It should be noted, that—during the initial 10 millisecond after power has been applied to the lamps—the cathodes will not reach incandescent temperatures. On the contrary, during that brief period, the cathodes will remain relatively cool; which implies that the cathode heating currents that have to be sensed by current transformers CT2 and CT3 are in effect the currents drawn by substantially cold cathodes.

Also, it is emphasized that the sensing of the proper presence of cathode heating currents takes place within the initial 10 millisecond after power is applied, and that therafter the cathode heating current sensing means is in effect disabled. Thus, lamps of the type where extra energy savings are obtained by way of having the cathodes internally open-up after the lamps have ignited (so as not continuously to draw heating current), will properly function in subject ballast circuit.

It is believed that the present invention and its several attendant advantages and features will be understood from the preceeding description. However, without departing from the spirit of the invention, changes may be in its form and in the construction and interrelationships of its component parts, the form herein presented merely representing the preferred embodiment.

I claim:

1. A protection means for a ballast , said ballast comprising an inverter circuit operable to power a fluorescent lamp, said fluorescent lamp having a pair of thermionic cathodes, each cathode having a pair of cathode terminals, said inverter circiut being adapted for connection with a DC power source and having: (i) a pair of main output terminals for providing a current-limited AC output voltage, (ii) two pairs of auxiliary output terminals for providing cathode heating current,(iii) shut-down means operable upon the receipt of a shut-down signal to substantially reduce the magnitude of said AC output voltage, and (iv) shut-down signal means operable to provide said shut-down signal except if prevented from doing so by a prevention signal provided to a prevention input, said cathode terminals being connected in circuit with said auxiliary output terminals, said thermonic cathodes being connected in circuit across said main output terminals, said protection means comprising:

prevention means connected in circuit with at least one of said thermonic cathodes and with said prevention input, and operative to sense the amount of cathode heating current and to provide said prevention signal except in the event that a least one of said thermonic cathodes were to draw less than a certain amount of cathode heating current.

2. A ballast for a fluorescent lamp, said fluorescent lamp having a first and a second thermionic cathode, said first cathode having a pair of cathode terminals, said ballast comprising an inverter means connected to a DC voltage and operable to provide a ballasted operating voltage for application between said first and second cathode as well as low-magnitude voltage for providing heating current to said first cathode, said inverter means being operable to be triggered into and out-of operation, said ballast further comprising:

first means operative to trigger said inverter into operation;

second means operative to trigger said inverter out-of operation within a brief time period after it has been triggered into operation, except if provided with a special signal during this time period; and sensor means connected in circuit with said first cathode and operable to provide said special signal within said time period as long as the magnitude of the heating current drawn by said first cathode exceeds a certain pre-determined level.

* * * * *